US007591082B2

(12) United States Patent
Lee et al.

(10) Patent No.: US 7,591,082 B2
(45) Date of Patent: Sep. 22, 2009

(54) LAUNDRY DRYER

(75) Inventors: Soon Jo Lee, Changwon-si (KR); Soo Won Park, Sacheon-si (KR)

(73) Assignee: LG Electronics Inc., Seoul (KR)

( * ) Notice: Subject to any disclaimer, the term of this patent is extended or adjusted under 35 U.S.C. 154(b) by 497 days.

(21) Appl. No.: 11/007,305

(22) Filed: Dec. 9, 2004

(65) Prior Publication Data

US 2005/0126035 A1 Jun. 16, 2005

(30) Foreign Application Priority Data

Dec. 10, 2003 (KR) ..... 10-2003-0089302
Dec. 10, 2003 (KR) ..... 10-2003-0089303
Dec. 16, 2003 (KR) ..... 10-2003-0091760

(51) Int. Cl.
*F26B 3/34* (2006.01)
*F26B 11/02* (2006.01)

(52) U.S. Cl. ..... 34/600; 34/237; 34/239

(58) Field of Classification Search ..... 34/600, 34/202, 237, 239, 104, 106, 437, 440; 248/317, 248/322; 211/124
See application file for complete search history.

(56) References Cited

U.S. PATENT DOCUMENTS 3,316,659 A * 5/1967 Lauck ..... 34/600
4,340,145 A * 7/1982 Cameron ..... 211/124
4,908,959 A * 3/1990 Kretchman et al. ..... 34/609
5,098,055 A * 3/1992 Leonian ..... 248/317

* cited by examiner

*Primary Examiner*—Jiping Lu
(74) *Attorney, Agent, or Firm*—Birch, Stewart, Kolasch & Birch, LLP

(57) ABSTRACT

There is provided a dry board received and fixed in a dry drum. The dry board is mounted in the dry drum and laundry such as shoes can be stably dried.

21 Claims, 8 Drawing Sheets

LAUNDRY DRYER

BACKGROUND OF THE INVENTION

1. Field of the Invention

The present invention relates to a laundry dryer, and more particularly, to a laundry dryer having a dry board on which tender clothes or shoes can be stably dried.

2. Description of the Related Art

Generally, a drum-type laundry dryer is designed to perform the drying operation while rotating laundry loaded in a dry drum. The laundry rotates and drops by the rotation of the laundry drum. High-temperature dry air introduced into the dry drum is mixed with the laundry to vaporize the moisture soaked in the laundry. The laundry dryer may be classified into a condenser-type dryer and an exhaust-type dryer. The former is designed such that the air in the dry drum is directed to a condenser and a heater and is then returned to the dry drum. That is, the air circulates in the dryer without being exhausted out of the dryer. The latter is designed such that the air in the dry drum is directed to the condenser so that the moisture contained in the air can be eliminated and is then exhausted out of the dryer.

Describing in more detail, in the condenser-type dryer, the air circulating in the dryer absorbs the moisture from the laundry loaded in the drum and passes through the condenser to be lowered in its temperature by a heat-exchange. As the temperature of the air is lowered, the moisture contained in the air is condensed. The condensed water is pumped out by an condensing pump and is then exhausted to an exterior side.

In the exhaust-type dryer, high-temperature high-moisture air absorbing moisture from the laundry in the drum is exhausted out of the dryer via a lint filter.

In both the exhaust-type and condenser type dryers, as the laundry lifts and drops by the rotation of the drum, heat-exchange is briskly incurred.

Meanwhile, in the case of the general laundry dryer, laundry loaded on the dry chamber are mixed together when the drum is rotating. At this point, various kinds of clothes are entangled such that the clothes are extended or worn out. Specifically, when the clothes are dried in the laundry dryer, they may be easily damaged. In addition, a special laundry, such as rubber shoes, which cannot be treated in the same manner as the general laundry, must be dried separately. Accordingly, the laundry drier must re-operate for the special laundry, resulting in the increase of power consumption. Further, there occurs a problem in that a user spends a long time in drying the laundry.

SUMMARY OF THE INVENTION

Accordingly, the present invention is directed to a laundry dryer that substantially obviates one or more problems due to limitations and disadvantages of the related art.

An object of the present invention is to provide a laundry dryer capable of drying special laundry, such as rubber shoes and wool, together with a general laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a laundry dryer including: a dry drum in which laundry is loaded; a dry board mounted in an inside of the dry drum, the laundry being put on a top side of the dry board; a hook mounted in one side of the dry board and fixed to an inside of the dry drum; and a front cover in which a front side of the dry board is stably received.

In another aspect of the present invention, there is provided a laundry dryer including: a dry drum; a hook having a plurality of bent portions, one end of the hook being inserted into a center of a rear wall of the dry drum; a dry board with which the hooked is coupled to install the dry board in the dry drum; a seating guide projected at a front bottom portion of the dry board to prevent a shaking; and a swing preventing projection projected at a bottom portion of the dry board to prevent a movement of the hook.

In a still another aspect of the present invention, there is provided a laundry dryer including: a dry drum; a dry board mounted in an inside of the dry drum, the dry board including seating guides projected at front bottom portions to prevent the dry board from shaking and a shake preventing part projected between the seating guides to prevent the dry board from shaking back and forth; a front cover supporting a front side of the dry board and having an opening through which laundry is loaded; a shake preventing projection projected at a bottom portion of the opening to prevent the dry board from shaking; and shake prevention ribs projected at positions spaced away from the shake prevention projection.

According to the present invention, the laundry, such as tender clothes or shoes, can be stably dried during one-time drying cycle.

In addition, since the drying operation need not be performed several times, the power consumption of the laundry dryer can be reduced. Further, a time necessary for the drying of the laundry can be reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
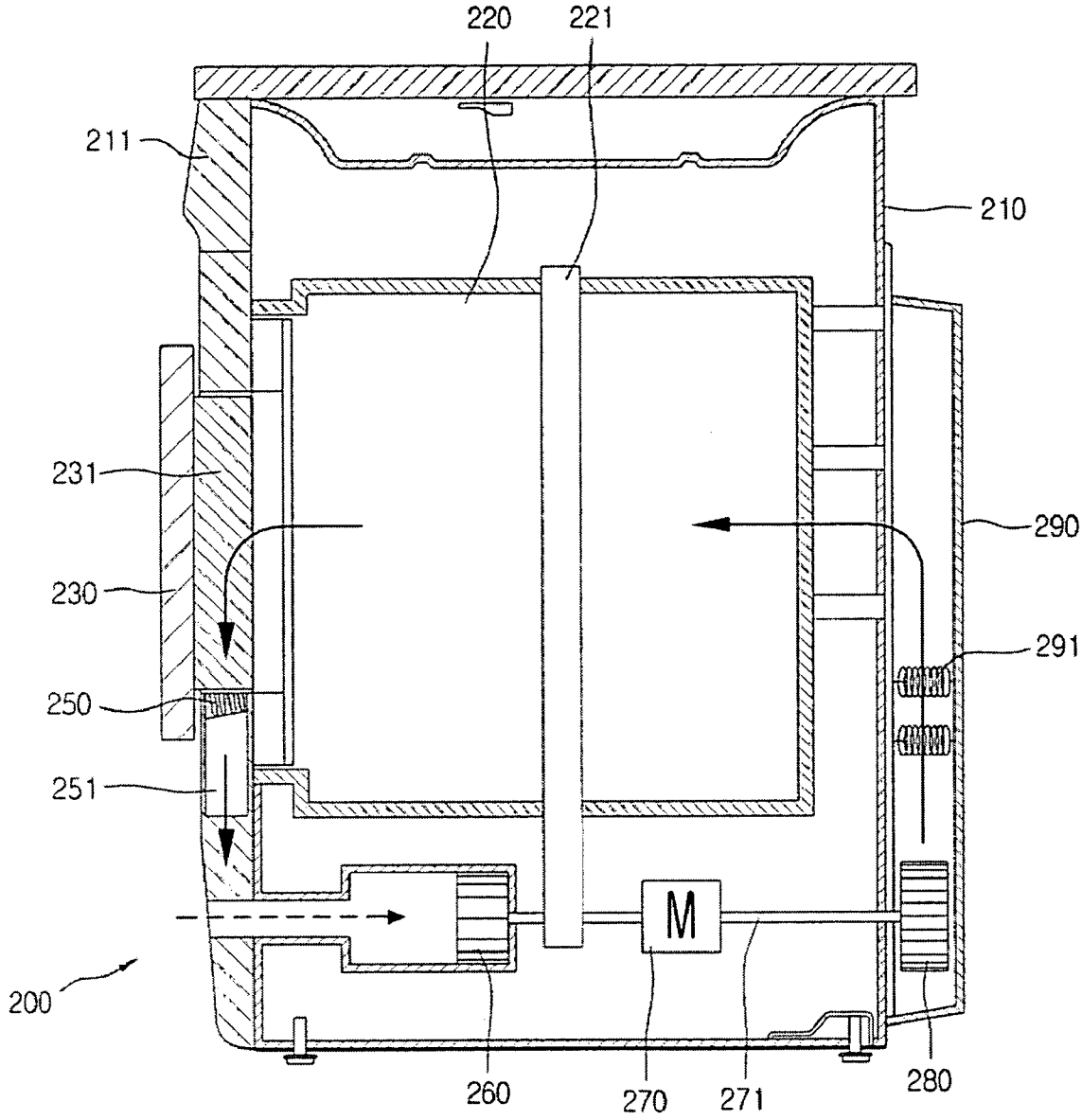
FIG. 1 is a sectional view of a condenser-type laundry dryer with a vibration/noise reduction device according to an embodiment of the present invention.

FIG. 1 is a sectional view of a condenser-type laundry dryer with a vibration/noise reduction device according to an embodiment of the present invention.

Referring to FIG. 1, a condenser-type laundry dryer 200 includes an outer case 210, a cylindrical drum 220 mounted in the outer case 210 to receive the laundry therein, a door 230 controlling the opening of the drum 220, and a belt 221 disposed around an outer circumference of the drum 220 to rotate the drum 220.

The condenser-type laundry dryer 200 further includes a motor shaft 271 connected to the belt 221 to transmit rotational force to the drum 220, a motor 270 for transmitting the rotational force to the motor shaft 271, and a cooling fan 260 connected to a first end of the motor shaft 271 to rotate by receiving the rotational force of the motor 270 and intake interior air. The laundry dryer 200 further includes a dry fan 280 connected to a second end of the motor shaft 271 to circulate air in the drum 220 and a duct cover 290 connecting the dry fan 280 to the drum 220 to allow the air introduced by the dry fan 280 to be directed to the drum 220. The cooling fan 260 and the dry fan 280 are disposed facing each other and the motor 270 is disposed between the cooling and dry fan 260 and 280. The dry fan 280 and the heater 291 are received in the duct cover 290 defining an air passage through which the circulation air introduced by the dry fan 280 is directed reward of the drum 220.

The dryer 200 is formed on a rear surface of the door 230, including a door lint filter 231 for primarily filtering foreign objects contained in the circulation air and a body lint filter 250 for secondary filtering foreign objects contained in the circulation air passing through the door lint filter 231. There is provided a circulation duct 251 along which the circulation air passing through the body lint duct 250 is directed to a condenser (not shown). There is further provided a drawer 211 for storing condensing water generated in the condenser.

The operation of the above-laundry dryer will be described hereinafter.

When electric power is applied to the dryer, the motor 270 rotates and the heater 291 mounted in the duct cover 290 is excited. Then, the belt 221 connected to the motor shaft 271 rotates to rotate the drum 220. As the drum 220 rotates, the laundry in the drum 220 is lifted and dropped by the lift (not shown) mounted on the inner wall of the drum 220.

Meanwhile, the dry fan 280 connected to the motor shaft 271 rotates by the rotation of the motor 270 to introduce the circulation air via the condenser. The air flows upward along the duct cover 290 and passes through the heater 291 to be converted into high-temperature/drying air. Then, the air is directed into the drum to absorb the moisture contained in the laundry, thereby being converted into the high-temperature/damp air.

The high-temperature damp air is directed to the condenser (not shown) along the circulation duct 251 via the door lint filter 231 and the body lint filter 250.

Meanwhile, as the cooling fan 260 connected to the motor shaft 271 rotates, outer interior air is induced into the dryer 200. The interior air is directed to the condenser via the cooling fan 260. The high-temperature/damp air and the interior air are not mixed with each other but heat-exchanged.

Accordingly, the high-temperature/damp air gives heat to the interior air as it goes through the condenser, thereby being changed into low-temperature/damp air, in the coursed of which the moisture contained in the low-temperature/damp air is condensed. The condensed moisture is dropt on the floor of the condenser and is then directed to a sump (not shown).

The moisture directed to the sump is transmitted to the drawer 211 disposed on an upper portion of the dryer. Meanwhile, the interior air passing trough the condenser takes the heat from the high-temperature/damp air to change the circulation air into the lower-temperature/damp air. As a result, the temperature of the interior air is increased.

Here, the circulation air introduced by the dry fan 280 flows along the passage defined by the duct cover 290. Then, as it passes through the heater 291, it is changed into the high-temperature/drying air and is then directed into the drum 220.

As described above, the circulation air circulates in the order of the drum, the lint filters, the condenser and the duct cover.

Figure 2:
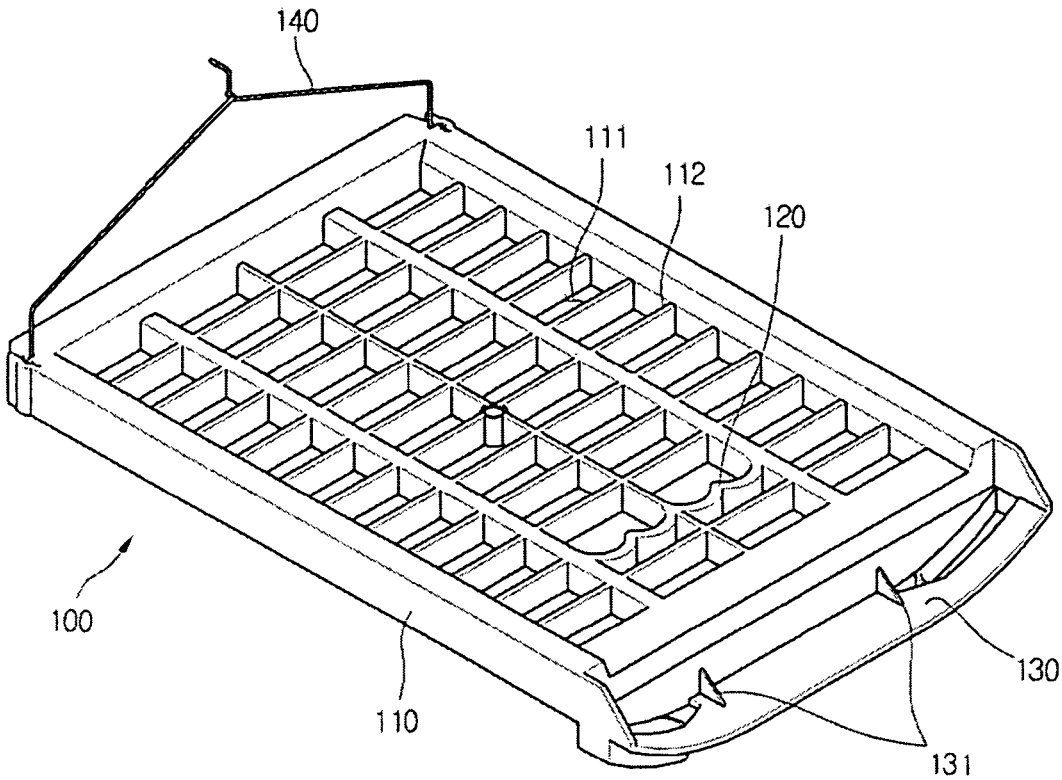
FIG. 2 is a front perspective view of a dry board according to the present invention.

FIG. 2 is a front perspective view of a dry board according to the present invention.

Referring to FIG. 2, a dry board 100 to be installed in the drum 220 is designed such that laundry such as shoes can be easily seated on its top.

The dry board includes a rectangular frame 110, a grill 112, and a triangular hook 140. The length of the frame 110 is substantially equal to that of the drum 220, and the grill 112 is formed inside the frame 110. The triangular hook 140 is inserted at a rear portion of the frame 110 to keep the frame in a horizontal position.

Further, the frame 110 includes a grip part 120, a cover matching part 130, and reinforcement ribs 131. The grip part 120 is formed at a portion of the grill 112 with a curved shape for an easy grip. The cover matching part 130 is formed at a front lower portion of the frame 110 to be received in a front cover of the drum (refer to 205 in FIG. 7). The ribs 131 are formed to support the cover matching part 130.

Drain holes are defined between bars of the grill 112 to drain dropping water from the laundry and easily circulate air in the drum 220.

Herein, the shape and location of the grip part 130 is not limited to this embodiment. The grip part 130 may be formed with any shape and at any location to allow the user to grip it easily.

To mount the dry board 100 in the drum 220, the triangular hook 140 is inserted at a rear wall of the drum 220 and then the cover matching part 130 is stably received in the front cover 205. After that, laundry such as shoes is loaded on the dry board 100.

The structure and mount steps of the dry board will now be described more fully with reference to accompanying drawings.

Figure 3:
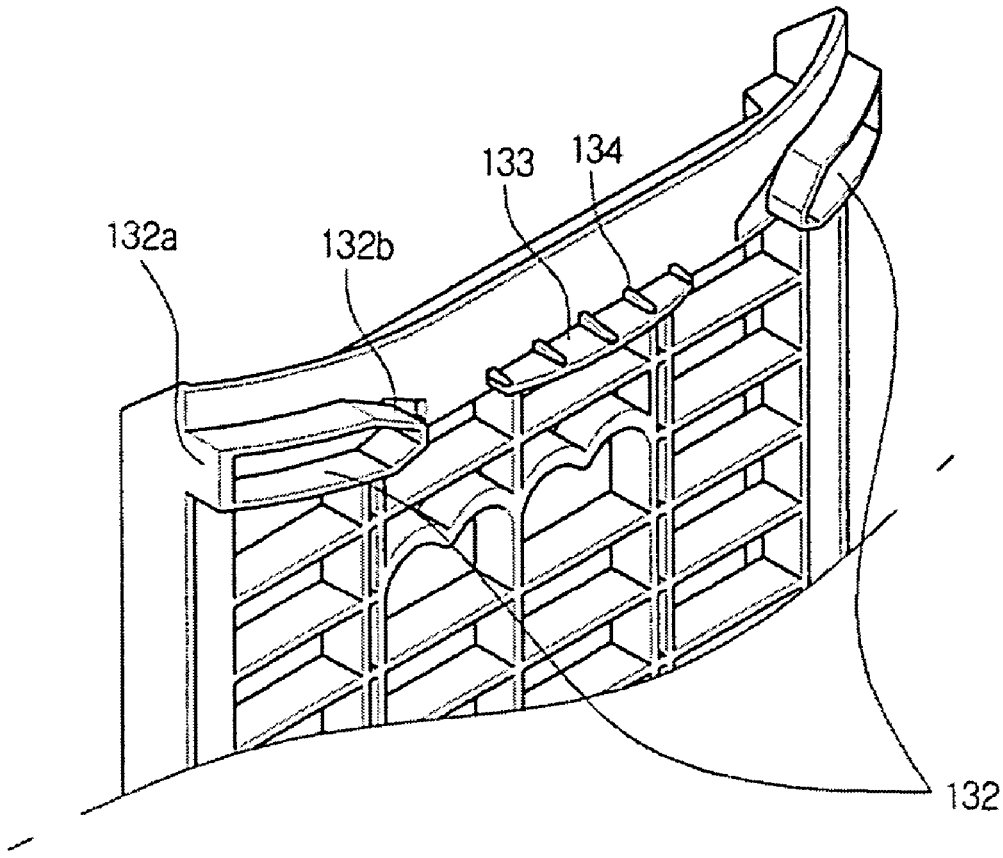
FIG. 3 is a partial perspective view showing a front lower portion of a dry board according to the present invention.

FIG. 3 is a partial perspective view showing a front lower portion of a dry board according to the present invention.

Referring to FIG. 3, the dry board 100 includes seating guides 132, a shake prevention part 133, and supporting ribs 134. Each seating guides 132 is projected from each side of the front lower portion of the dry board 100 with a predetermined length and height. The shake prevention part 133 is formed at a center of a bottom side of the cover matching part 130 with a predetermined height and width in order to prevent the dry board 100 from moving in forward and backward directions. The supporting ribs 134 are formed to support the shake prevention part 133.

Each of the seating guides 132 has inwardly inclined faces 132*b* and an outer face 132*a* that is flush with a side end of the frame 110. The seating guides 132 stably seats the cover matching part 130 in an exact position of the front cover 205, and then the shake prevention part 133 prevents the dry board 100 from moving in the forward and backward directions.

Further, each of the seating guides 132 defines an opened space therein to prevent its deformation, for example, during its injection molding process.

Figure 4:
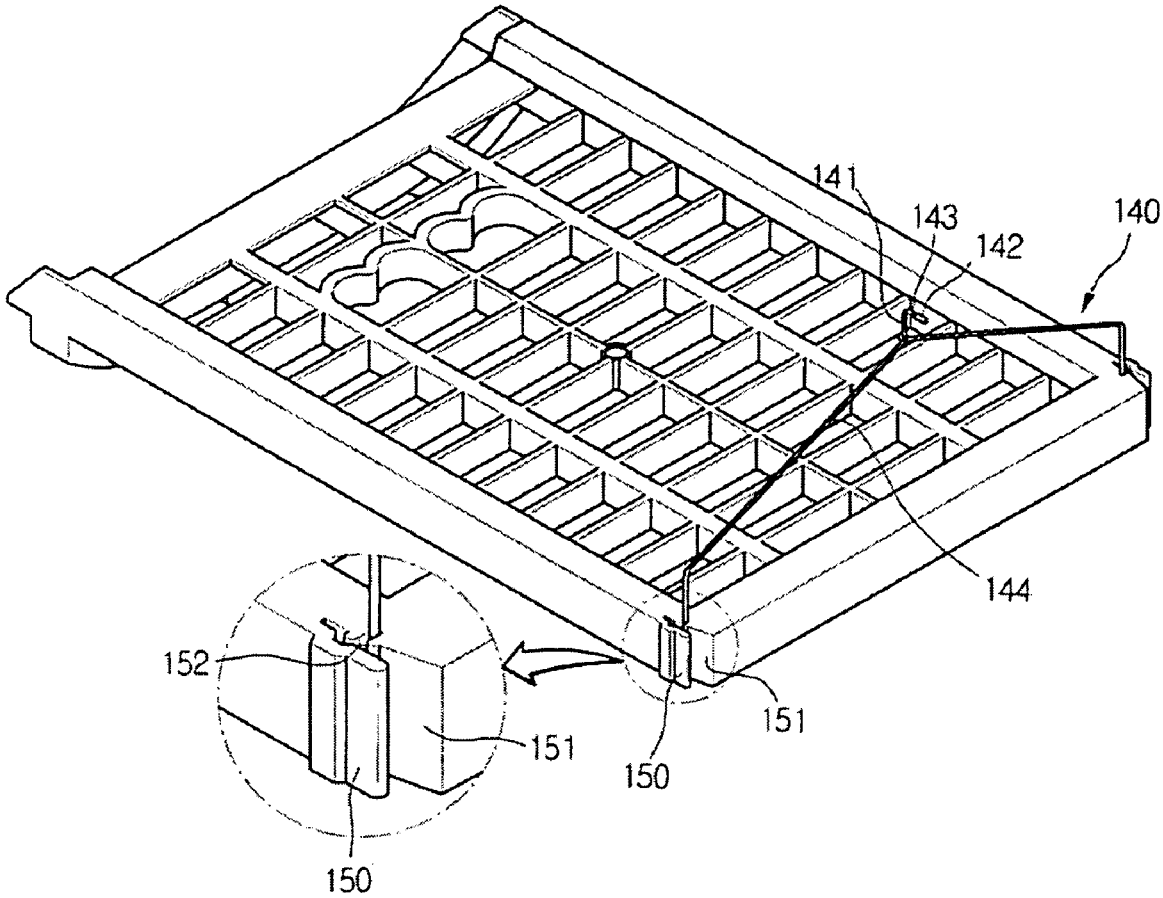
FIG. 4 is a bottom perspective view of a dry board according to the present invention.
Figure 5:
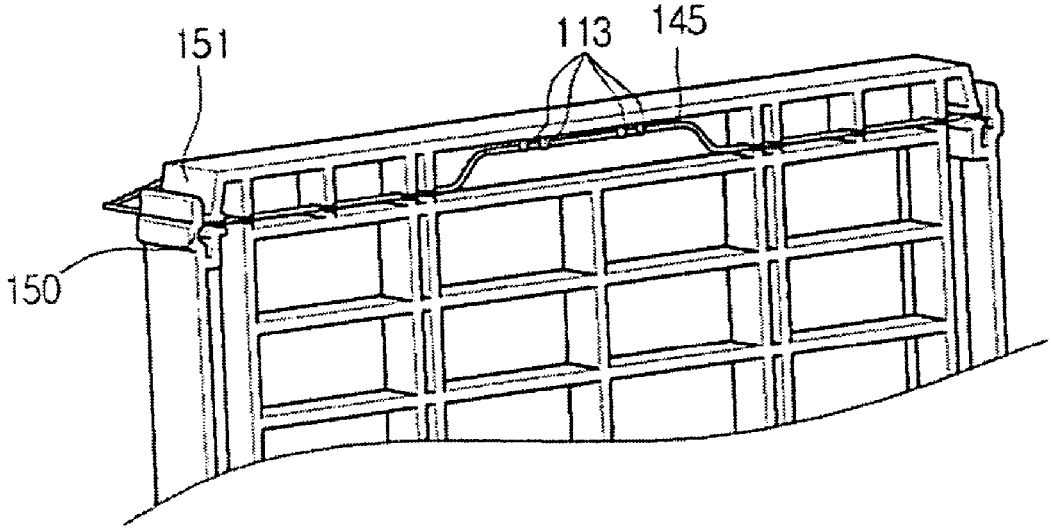
FIG. 5 is a partial perspective view showing a back lower portion of a dry board according to the present invention.

FIG. 4 is a bottom perspective view of a dry board, and FIG. 5 is a partial perspective view showing a back lower portion of a dry board.

Referring to FIGS. 4 and 5, the dry board 100 includes guide ribs 150, guide faces 151, and fixing grooves 152. The guide ribs 150 are formed at both backward corners of the dry board 100 to guide the insertion of the triangular hook 140. The guide faces 151 guide the triangular hook 140 toward the insides of the guide ribs 150. The fixing grooves 152 receives the inserted triangular hook 140, such that the inserted triangular hook 140 can be securely held at the both backward corners of the dry board 100.

In detail, each of the guide faces 151 is inclined at a predetermined angle, such that the triangular hook 140 is extended when it is guided by the guide faces toward the insides of the guide ribs 150. The extended triangular hook 140 is retracted when it is received in the fixing grooves 152, such that the triangular hook 140 can be securely coupled with the dry board 100.

Further, the triangular hook has vertical portions for the coupling with the dry board 100 and inclined portions 144 each extending from each of the vertical portions at a predetermined angle. The inclined portions 144 meet each other at their ends with one end winding the other end.

Further, the triangular hook 140 includes a vertical portion 141 extended from one end of the inclined portions 144, a horizontal portion 143 bent backwardly from the vertical portion 141, and a cap 142 put on the horizontal portion 143.

Further, the dry board 100 includes at least one swing prevention projection 1134 at the bottom side thereof to prevent the triangular hook 140 from swinging when it couples with the dry board 100. To receive and hold lower portion of the triangular hook 2140, the grill 112 defines a groove at a bottom back portion.

The dry board 100 may be fabricated using various methods. Preferably, the dry board 100 can be made in one-piece using an injection molding method in order to reduce fabrication processes and cost.

As described above, the triangular hook 140 is attached to the dry board 100 to install the dry board 100 in the drum 220 at a predetermined height and in a horizontal position. The cap 142 of the triangular cap 140 is inserted in a hole defined at a rear wall of the drum 220. The lower portion of the triangular hook 140 is inserted in the groove defined at the bottom back portion of the grill 112.

The inserting step of the triangular hook 140 to the dry board 100 will now be described more fully.

In inserting step, the triangular hook 140 is pushed inwardly along the guide faces 151 and the guide ribs 150, and then the vertical portions of the triangular hook 140 are inserted in the fixing grooves 152.

The guide ribs 150 are elastic such that they extend outwardly to receive the triangular hook 140 when the triangular hook 140 is pushed thereto. The triangular hook 140 is spread outwardly when it is pushed along the guide faces 151, such that the triangular hook 140 is retracted at the fixing grooves 152 by its restoring force and thereby securely inserted in the fixing grooves 152. By the same principle, the guide ribs 150 are retracted to their original position.

By pulling the triangular hook 140 upwardly, the lower portion of the triangular hook is inserted in the groove defined at the bottom back portion of the grill 112. Also, the triangular hook 140 includes a curved portion 145 at a center of the lower portion thereof in order to couple with the swing prevention projection 113 of the dry board 100, for a further securable fitting.

Figure 6:
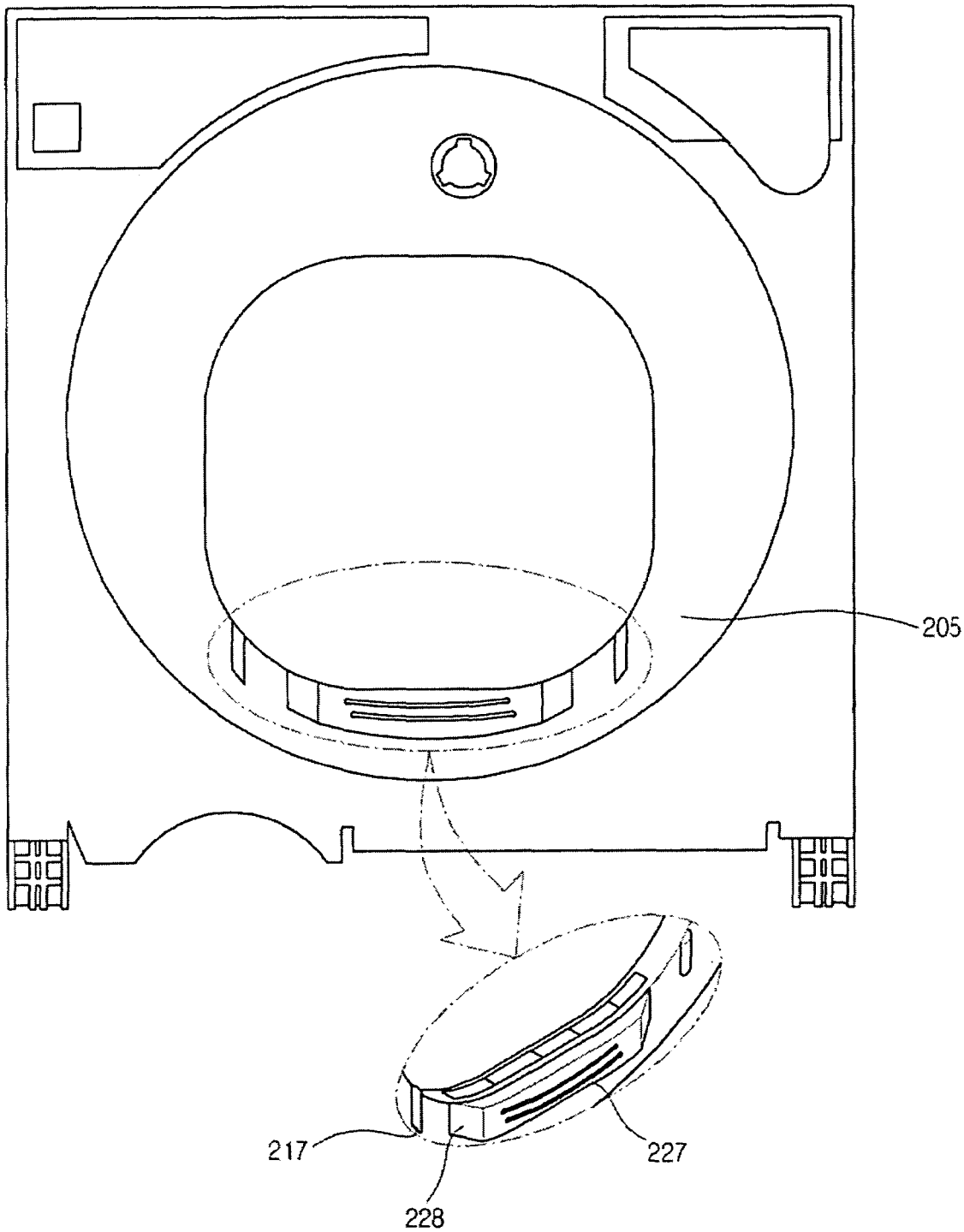
FIG. 6 is a perspective view of a front cover in which a dry board to be received according to the present invention.

FIG. 6 is a perspective view of a front cover in which a dry board to be received according to the present invention.

Referring to FIG. 6, the front cover 205, in which the dry board 100 to be received, includes a shake prevention projection 227 and a shake prevention ribs 217. The shake prevention projection 227 is protruded at a lower portion of the drum 220 and includes inclined portions 228 at each side thereof. The shake prevention ribs 217 interpose the shake prevention projection 227 therebetween and are positioned in vertical directions. The cover matching part 130 of the dry board 100 is received on a top of the shake prevention projection 227, and shake prevention projection 227 is positioned between the seating guides 132 of the cover matching part 130.

Further, the shake prevention part 133 of the dry board 100 comes into contact with the shake prevention projection 227.

In detail, the inclined faces 228 of the shake prevention projection 227 and the inclined faces 132*b* of the seating guides 132 are abutted each other. Also, the outer faces 132*a* and the shake prevention ribs 217 are brought into contact with each other. In other words, each of the seating guides 132 is inserted between the shake prevention projection 227 and the shake prevention rib 217 such that the dry board 100 can be prevented from moving in right and left directions. In addition, the shake prevention part 133 of the dry board 100 prevents the dry board 100 from moving in forward and backward directions.

Figure 7:
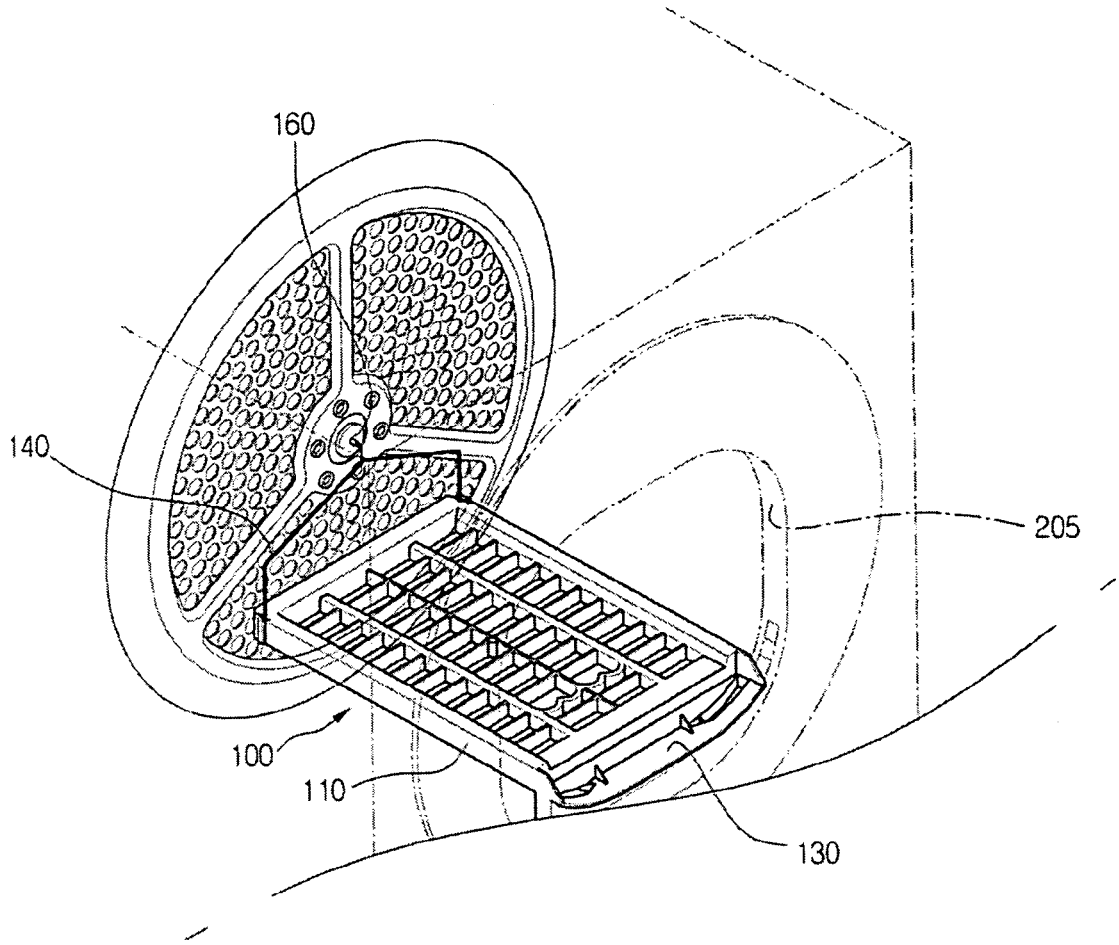
FIG. 7 is a partial perspective view showing a dry board installed in a drum according to the present invention.
Figure 8:
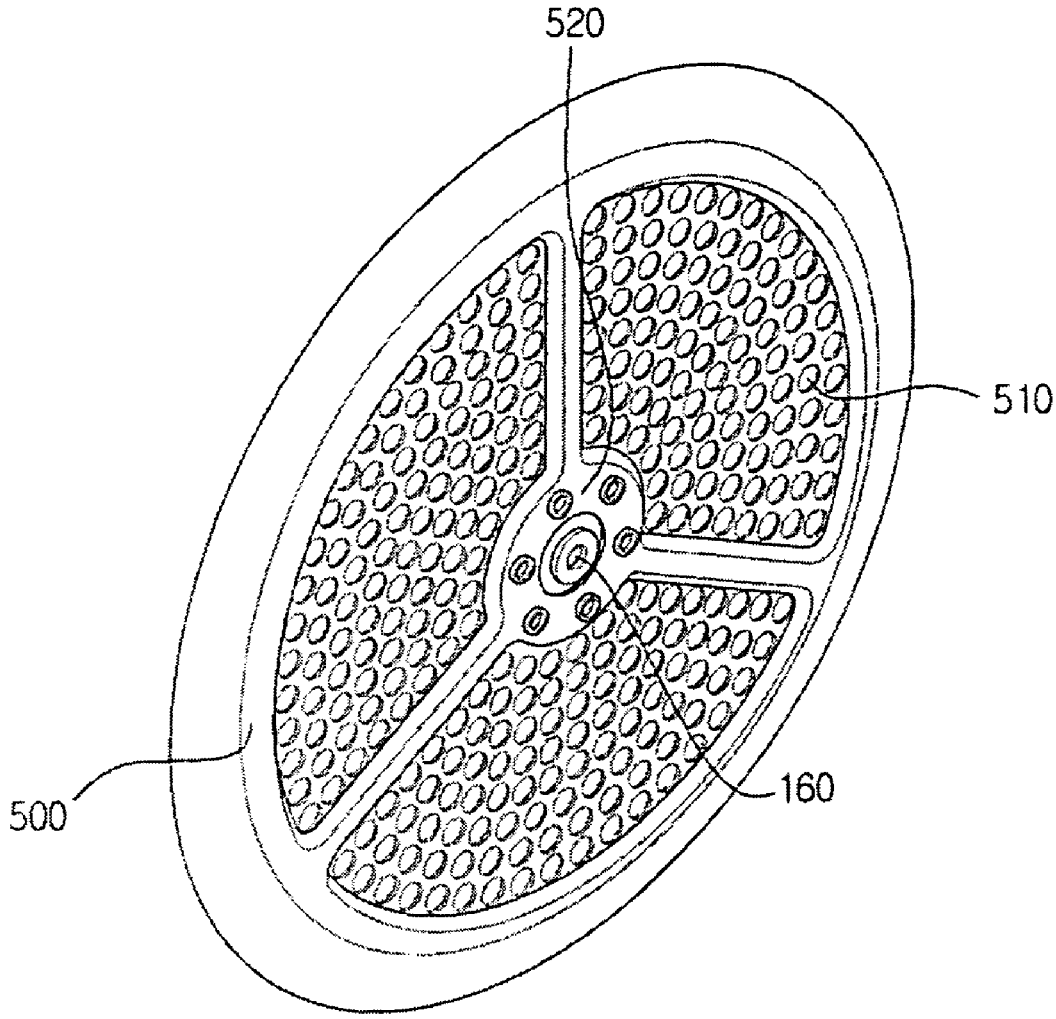
FIG. 8 is a perspective view showing a drum rear wall defining a cap hole according to the present invention.

FIG. 7 is a partial perspective view showing a dry board installed in a drum according to the present invention, and FIG. 8 is a perspective view showing a drum rear wall defining a cap hole according to the present invention.

Referring to FIGS. 7 and 8, the cover matching part 130 formed at the front of the dry board 100 is seated on the front cover 205, and the back of the dry board 100 is suspended from a rear wall 500 of the drum 220 by using the triangular hook 140.

In detail, the rear wall 500 includes a plurality of through holes 510, a housing 520, and a cap hole 160. The plurality of through holes 510 are defined to pass high-temperature dry air from a dry duct (not shown) into the drum 220. The housing 520 is formed at a center of the rear wall 500 and defines a concaved portion to receive a journal bearing for supporting a shaft of the drum 220. The cap hole 160 is defined at a center of the housing 520 for the insertion of the cap 142 of the triangular hook 140.

Meanwhile, though the cap hole 160 can be directly formed at the center of the housing 520 for the insertion of the cap 142, an injection molded part having appropriate size and depth may be inserted in the cap hole 160 to receive the cap 142. The injection molded part may allow more close insertion relationship with the cap 142, such that the triangular hook 140 can be securely fixed in the drum 220.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A laundry dryer comprising:

a drum;

a front cover having an opening for loading laundry and a projection protruding inwardly and shake prevention ribs located at a lower portion of the drum to support a front end of a dry board;

the dry board mounted in an inside of the dry drum and including seating guides projected at front bottom portions thereof for being positioned in an opening located between the front cover projection and the shake projecting ribs to prevent the dry board from shaking side-to-side and a further shake preventing part projected between the seating guides for contacting the front cover projection to prevent the dry board from shaking forward and rearward in the dryer.

2. The laundry dryer according to claim 1, wherein the inwardly protruding projection has a side inclined at a predetermined angle.

3. The laundry dryer according to claim 1, wherein each of the seating guides is interposed between the inwardly protruding projection and the further shake prevention part.

4. The laundry dryer according to claim 1, wherein each of the seating guides has an inner side inclined at a predetermined angle, such that the seating guides are adapted to be closely abutted against plural sides of the cover projection.

5. A laundry dryer comprising:

a drum for containing laundry;

a dry board having a frame mounted inside of the drum for supporting laundry on a top side of the dry board;

a triangular shaped hook removably insertable into a back portion of the dry board and coupled to two opposite sided of the dry board frame and extending vertically from at least two sides of the dry board and having a portion bent backward from the vertical for attachment to a rear side of the dry drum; and a front cover for stably supporting a front portion of the dry board, wherein the dry board includes a plurality of fixing grooves into which the triangular shaped hook is inserted, and the plurality of fixing grooves include a first fixing groove formed at one side of the dry board, a second fixing groove formed at the other side of the dry board and a third fixing groove formed at a bottom portion of the dry board, and wherein the front cover includes an opening for loading laundry and a projection protruding inwardly and shake prevention ribs located at a lower portion of the drum to support a front end of the dry board, the dry board further includes seating guides projected at front bottom portions thereof for being positioned in an opening located between the front cover projection and the shake preventing ribs to prevent the dry board from shaking side-to-side and a further shake preventing part projected between the seating guides for contacting the front cover projection to prevent the dry board from shaking forward and rearward in the dryer.

6. The laundry dryer according to claim 5, wherein the hook is coupled at a rear side of the dry board.

7. The laundry dryer according to claim 5, wherein the dry board includes:

a frame forming an outer appearance; and a plurality of through holes formed in an inside of the frame.

8. The laundry dryer according to claim 5, wherein the dry board includes a cover matching part extending from a front side thereof to sit in the front cover.

9. The laundry dryer according to claim 8, wherein the cover matching part includes at least one reinforcement rib formed on an upper portion.

10. The laundry dryer according to claim 8, wherein the dry board includes a guide rib formed at side edge for an easy insertion of the hook, and the guide rib covers a portion of the triangular shaped hook when the triangular shaped hook is inserted into the plurality of fixing grooves.

11. The laundry dryer according to claim 5, wherein the dry board includes a curved grip part for an easy grip.

12. The laundry dryer according to claim 5, wherein the dry board includes a guide face formed at a side end and inclined at a predetermined angle for an easy insertion of the hook.

13. The laundry dryer according to claim 5, wherein the hook includes a cap put on an end thereof.

14. The laundry dryer according to claim 5, wherein the triangular shaped hook surrounds the dry board.

15. A laundry dryer comprising:

a dry drum;

a triangular shaped hook having a plurality of leg portions, one end of the hook being adapted to be inserted into a center of a rear wall of the dry drum;

a front cover having an opening for loading laundry and a projection protruding inwardly and shake prevention ribs located at a lower portion of the drum to support a front end of a dry board; and the dry board having fixing grooves for receiving the hook leg portions for coupling the dry board and the hook, and guide ribs for guiding receiving of the hook leg portions and covering a portion of the hook leg portions when the hook leg portions are inserted into the fixing grooves, said hook being removably insertable into a back portion of the dry board;

wherein the dry board further includes seating guides projected at front bottom portions thereof for being positioned in an opening located between the front cover projection and the shake preventing ribs to prevent the dry board from shaking side-to-side and a further shake preventing part projected between the seating guides for contacting the front cover projection to prevent the dry board from shaking forward and rearward in the dryer.

16. The laundry dryer according to claim 15, wherein the hook is fitted into both a bottom and each side of the dry board.

17. The laundry dryer according to claim 15, wherein the drum includes a hole formed at a center of the rear wall thereof, for an insertion of the hook.

18. The laundry dryer according to claim 15, wherein the drum includes a ring-shaped insertion member attached to a center of the rear wall thereof, for an insertion of an end of the hook.

19. The laundry dryer according to claim 15, wherein the hook includes a cap at an end to be inserted into the rear wall of the drum.

20. The laundry dryer according to claim 15, wherein the hook includes a forwardly curved portion and the dry board includes a swing prevention projection to hold the curved portion, for preventing movement of the hook.

21. The laundry dryer according to claim 15, wherein the triangular shaped hook surrounds the dry board.

* * * * *